US005667277A

United States Patent [19]

Van De Riet

[11] Patent Number: 5,667,277

[45] Date of Patent: Sep. 16, 1997

[54] HEIGHT ADJUSTABLE ARM REST ASSEMBLY

[75] Inventor: Douglas M. Van De Riet, Holland, Mich.

[73] Assignee: Herman Miller Inc., Zeeland, Mich.

[21] Appl. No.: 476,846

[22] Filed: Jun. 7, 1995

[51] Int. Cl.[6] ..... A47C 7/54

[52] U.S. Cl. ..... 297/411.36; 297/411.2

[58] Field of Search ..... 297/411.2, 411.35, 297/411.36, 440.24; 248/118, 118.3

[56] References Cited

U.S. PATENT DOCUMENTS

| | | | |
|---|---|---|---|
| 245,639 | 8/1881 | Lay . | |
| 351,801 | 11/1886 | Schilling . | |
| 488,773 | 12/1892 | Peck . | |
| 638,534 | 12/1899 | Welch . | |
| 1,260,032 | 3/1918 | Perpick . | |
| 1,407,174 | 2/1922 | Simpson . | |
| 2,569,834 | 10/1951 | Smith . | |
| 3,300,250 | 1/1967 | Dollgener et al. . | |
| 4,176,878 | 12/1979 | Koutsky . | |
| 4,244,623 | 1/1981 | Hall et al. . | |
| 4,277,102 | 7/1981 | Aaras et al. . | |
| 4,311,338 | 1/1982 | Moorhouse . | |
| 4,872,727 | 10/1989 | Rye . | |
| 4,884,846 | 12/1989 | Tobler . | |
| 4,951,995 | 8/1990 | Teppo et al. . | |
| 5,143,422 | 9/1992 | Althofer et al. . | |
| 5,199,765 | 4/1993 | Garmendia et al. . | |
| 5,324,096 | 6/1994 | Schultz | 297/411.36 |
| 5,326,154 | 7/1994 | Williamson et al. | 297/411.36 |
| 5,382,079 | 1/1995 | Wilson et al. . | |
| 5,388,892 | 2/1995 | Tornero | 297/411.36 |
| 5,393,124 | 2/1995 | Neil | 297/411.36 X |
| 5,393,125 | 2/1995 | Watson et al. . | |

FOREIGN PATENT DOCUMENTS

| | | | |
|---|---|---|---|
| 82304871 | 6/1983 | European Pat. Off. . | |
| 4317610 | 12/1994 | Germany | 297/411.35 |
| WO 93/25121 | 12/1993 | WIPO . | |

*Primary Examiner*—Milton Nelson, Jr.
*Attorney, Agent, or Firm*—Brinks Hofer Gilson & Lione

[57] ABSTRACT

A height adjustable arm rest assembly for use on a chair, the arm rest assembly includes a support member, an arm rest member, a locking mechanism attached to one of the support member and the arm rest member, and a substantially continuous engagement surface on the other of the support member and the arm rest member. The support member is attached to the chair and extends substantially upward therefrom. The arm rest member is movably attached to the support member and extends substantially coaxially therewith. The locking mechanism is attached to one of the support member and the arm rest member in order to secure the arm rest member in a selected vertical position relative to the support member. The locking mechanism includes an actuation member, a link connected to the actuation member, and a cam pivotably connected to the link. The cam has a front portion and a rear portion. The rear portion is received within a recess in one of the support member and the arm rest member. The recess is sized slightly larger than the rear portion of the cam in order to allow the cam to pivot about a generally horizontal axis through the rear of the cam. The cam is pivotable from a first position to a second position within the recess. A substantially continuous engagement surface is located on the other of the support member and the arm rest member.

30 Claims, 5 Drawing Sheets

HEIGHT ADJUSTABLE ARM REST ASSEMBLY

BACKGROUND OF THE INVENTION

The present invention relates to the field of arm rests for use on chairs. More particularly, the invention relates to the field of arm rests which are adjustable to selected heights to provide a more comfortable chair for a user.

Chairs, particularly office chairs, are often designed with the arm rests secured in a fixed position based on the intended use of the chair and the average size of the expected users. However, in an office environment, people of different sizes may spend many hours in a chair. Therefore, it is desirable to have arm rests that are adjustable to match the specific anatomy of a given user. A chair, in particular the arm rests, should be comfortable for people of all sizes and shapes. Similarly, arm rests should be adjustable depending on the varied activities of the user of the chair. For example, a user may desire an arm rest at a first height when working with a pen and paper on a desk, but desire a second height when working with a computer.

Some adjustable arm rests have been disclosed in the prior art. For example, in U.S. Pat. No. 4,951,995 issued to Teppo et. al., a complex arm height adjustment mechanism for a chair is disclosed. A vertical motion translation mechanism interconnects two laterally spaced arm rests. A cable assembly together with a rotatable gear translate movement from a first arm into a corresponding movement in the second arm thereby providing for the synchronized movement of the arm rest assembly. U.S. Pat. No. 4,884,846 issued to Tobler, discloses arm rests with limited height adjustment capabilities. The arm rest is adjusted through the rotation of a carrier element on the arm rest support. The support element is a two part bolt construction with right-hand and left-hand threads coupled together by the carrier element.

While the above-described arm rests have been previously known, there still exists a need for adjustable arm rests that provide reliable operation.

SUMMARY OF THE INVENTION

Briefly, the present invention is directed to a height adjustable arm rest assembly for use on a chair. According to one aspect of the invention, the arm rest assembly includes a support member, an arm rest member, a locking mechanism attached to one of the support member and the arm rest member, and a substantially continuous engagement surface on the other of the support member and the arm rest member. The support member is attached to the chair and extends substantially upward therefrom. The arm rest member is movably attached to the support member and extends substantially coaxially therewith. The locking mechanism is attached to one of the support member and the arm rest member in order to secure the arm rest member in a selected vertical position relative to the support member. The locking mechanism includes an actuation member, a link connected to the actuation member, and a cam pivotably connected to the link. The cam has a front portion and a rear portion. The rear portion is received within a recess in one of the support member and the arm rest member. The recess is sized slightly larger than the rear portion of the cam in order to allow the cam to pivot about a generally horizontal axis through the rear of the cam. The cam is pivotable from a first position to a second position within the recess. A substantially continuous engagement surface is located on the other of the support member and the arm rest member. The cam is positioned adjacent the continuous engagement surface and is pivotable into and out of engagement with the continuous engagement surface in response to the actuation member in order to thereby provide the arm rest member with selective height adjustability.

According to another aspect of the present invention, the locking mechanism is attached to the arm rest member and the continuous engagement surface is formed on the inner surface of the support member.

According to a further aspect of the present invention, the lower portion of the link includes a lever arm that contacts a pin positioned in a second recess of the arm rest member.

According to yet another aspect of the present invention, a T-shaped stop member is positioned in a correspondingly shaped aperture in a lower portion of the arm rest member. The stop member includes a raised surface that rides within a channel in the support member.

As used herein, the term "continuous engagement surface" is intended to include surfaces that are perfectly smooth or are slightly irregular, e.g., including shallow grooves therein.

Also, as used herein, elements are "disengaged" when they are capable of substantial movement with respect to one another.

The present invention, together with attendant objects and advantages, will be best understood with reference to the detailed description below read in conjunction with the accompanying drawings.

DETAILED DESCRIPTION OF THE PREFERRED EMBODIMENTS

Figure 1:
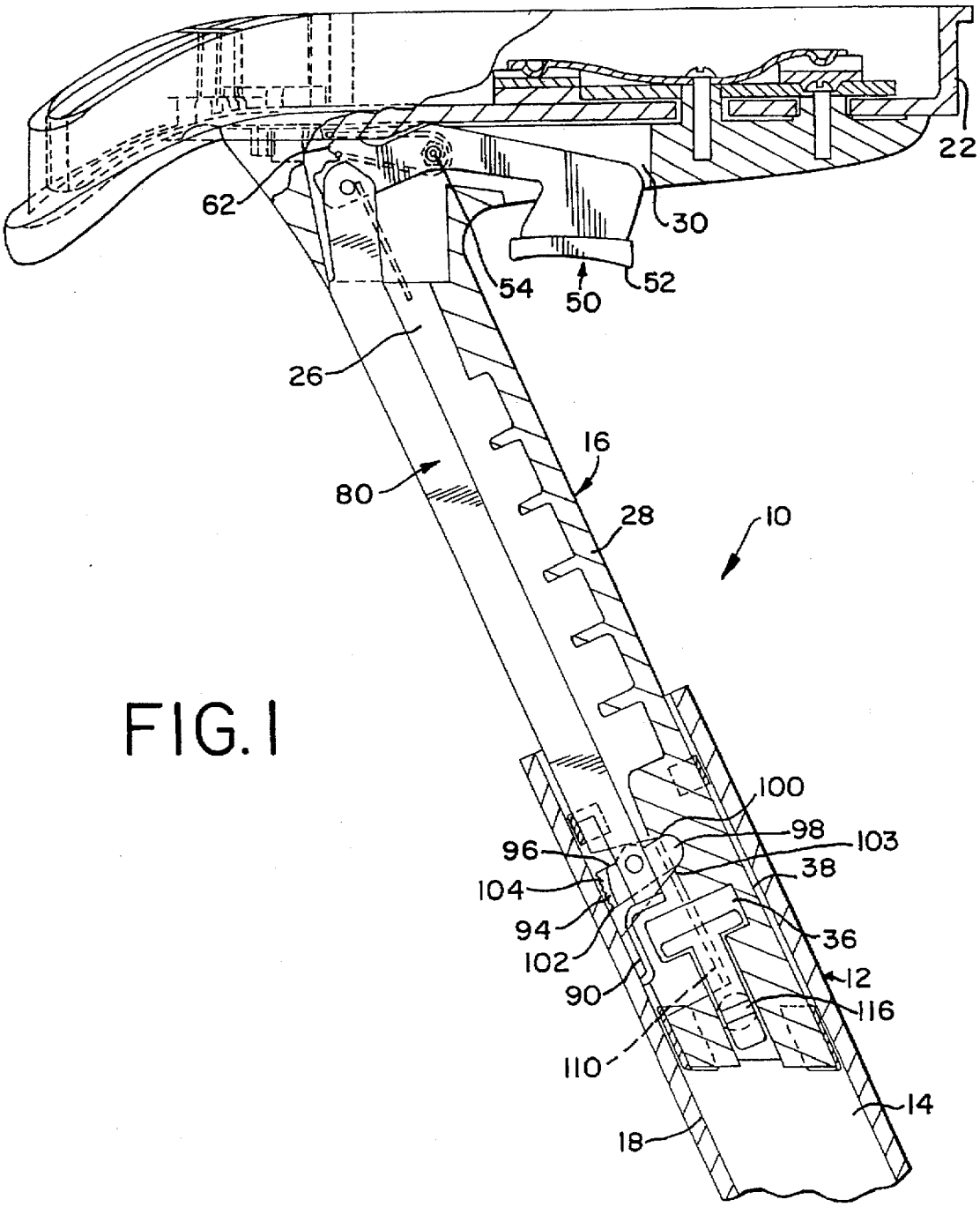
FIG. 1 is a side view in partial cross-section of a first preferred embodiment of the height adjustable arm rest assembly of the present invention with the arm rest member locked into position first height.
Figure 3:
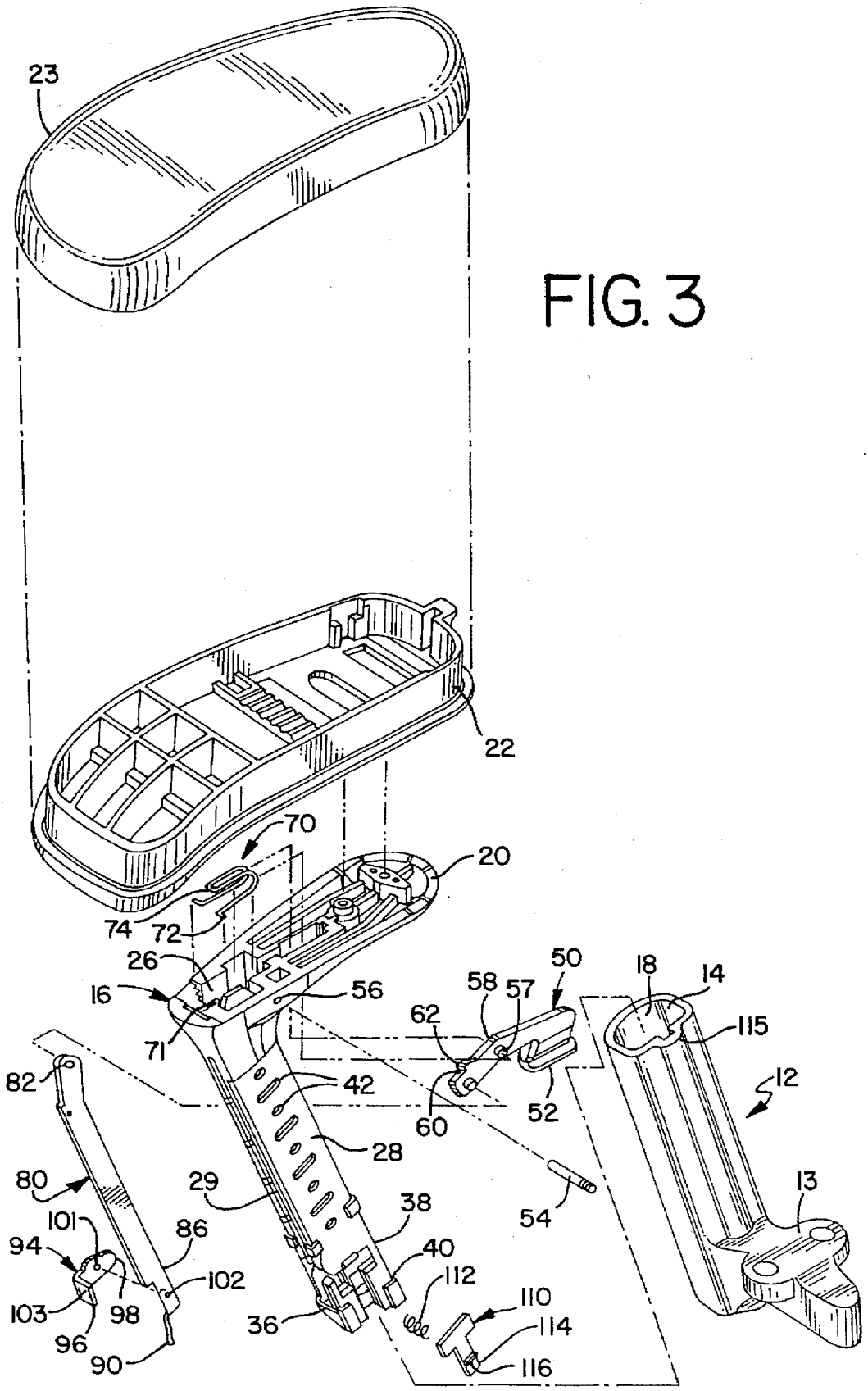
FIG. 3 is an exploded view of the preferred embodiment shown in FIGS. 1–2.

Referring to the drawings, FIG. 1 shows an adjustable arm rest assembly 10 for use on a chair in accordance with the present invention. The assembly 10 includes a support member 12 or tube that is fixed to a chair beneath the seat thereof. As shown in FIG. 3, a mounting element 13 extends outward from beneath the seat with the support member 12 extending vertically upward therefrom. The support member 12 has an internal passageway 14 that movably receives the arm rest member 16. The passageway 14 is defined by the D-shaped inner wall 18. In a first preferred embodiment, the inner wall 18 is knurled so as to include a plurality of shallow horizontal grooves. Preferably, the grooves have a depth of approximately 4–6 thousandths of an inch. In another preferred embodiment, the inner wall 18 is substantially smooth. While the support member 12 may be formed from many different materials known to those of ordinary skill in the art, the support member 12 is preferably formed from aluminum using a die cast process.

The arm rest member 16, preferably formed from 30% glass-filled nylon polyamide, is movably received within the passageway 14. As shown in FIG. 3, the arm rest member 16 has a top surface 20 that is connected to the adjustable arm rest housing 22. The arm pad 23 is secured to the housing 22 in order to support the arm of a user thereon. For a description of the adjustable arm rest housing 22, reference is made to the commonly assigned application filed on Jun. 7, 1995, in the names of Douglas Van De Riet and Jeffery Webber, entitled ADJUSTABLE ARM REST, the disclosure of which is expressly incorporated herein. A passageway 26 extends downward from the top surface 20 and substantially along the stem 28. The slot 29 opens up into the passageway 26 and runs along the length of the stem 28. A first cavity 30 is connected to the passageway 26 adjacent the top surface 20 of the arm rest member 16. A T-shaped second cavity 36 is located in a lower portion 38 of the stem 28. A substantially circular third cavity 40 opens up into the second cavity 36. Markings 42 may be placed along the stem 28 to allow a user to gauge the relative position of the arm rest member 16 and the support member 12.

An actuation member 50 is pivotably mounted within the first cavity 30 of the arm rest member 16. The button 52 extends downward and out from the first cavity 30. A pin 54 is mounted within the arm rest member 16 and passes through an aperture 56 in the arm rest member 16, an aperture 57 in the actuation member 50 and back into the arm rest member 16. The pin 54 defines a pivot axis about which the actuation member 50 moves when depressed by a user. A small hub 58 projects outward from the end 60 of the actuation member 50. In addition, a spring-engagement finger 62 is positioned slightly above the hub 58 and extends in a direction along the length of the housing 22. In a preferred embodiment, the actuation member 50 is manufactured from ABS polycarbonate and the pin 54 from steel (12L14).

A U-shaped spring 70 acts to bias the actuation member 50. The spring 70 is mounted within the top portion 71 of the passageway 26. The end portion 72 of the spring 70 engages a mounting ledge within the passageway 26. The curved portion 74 of the spring 70 engages the actuation element 50 just beneath the finger 62. The finger 62 secures the curved portion 74 of the spring 70 to the actuation element 50. In a preferred embodiment, the spring 70 is manufactured from piano wire.

The link 80, preferably manufactured from 30% glass-filed nylon, is connected to the end 60 of the actuation member 50. More specifically, the link 80 has an aperture 82 that is sized to movably receive the hub 58. The lower portion 86 of the link 80 has a cut-out portion 88. In addition, the finger 90 projects downward and outward from beneath the cut-out 88 and projects toward the inner wall 18 of the support member 12.

Figure 2:
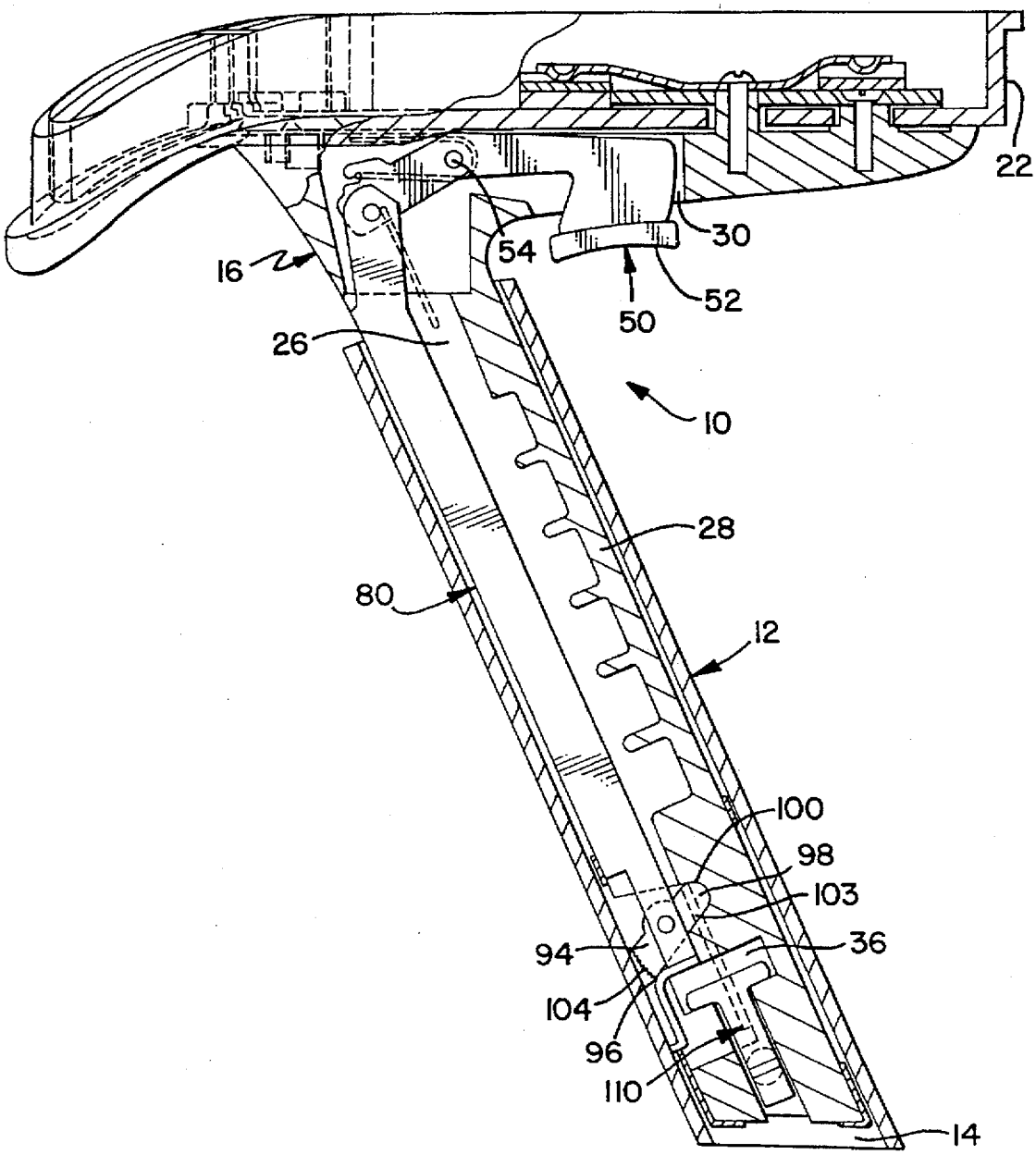
FIG.2 is a side view in partial cross-section of the preferred embodiment of the present invention shown in FIG. 1 with the arm rest member in an unlocked position at a second height.

As shown in FIGS. 1 and 2, a cam or wedge 94 is movably connected to the link 80 within the cut-out 88. The cam 94 has a centrally located aperture 101 that receives the small hub 102 extending from the lower portion 86 of the link 80. The cam 94 has a front portion 96 and a rear portion 98. The rear portion 98 is received within a recess 100 within the stem 28 of the arm rest member 16. In this preferred embodiment, the recess 100 has a substantially V-shaped or wedge-shaped configuration and a curved rear wall 103 that substantially conforms with the rear portion 98 of the cam 94. The recess 100 has a width substantially equal to the width of the cam 94 and opens toward the inner wall 18 of the support member 12. The front portion 96 of the cam 94 has a plurality of longitudinally extending teeth 103. While the cam 94, as well as the other elements of this invention, may be made from many different materials known to those of ordinary skill in the art, preferably a powder metal (FN 0205) is used to manufacture the cam 94.

A T-shaped stop member 110 is received within the correspondingly shaped second cavity 36 with the spring 112 captured within the third cavity 40. The spring 112 acts to bias the lower portion 114 of the stop member 110 into engagement with a channel 115 that runs vertically along the inner wall 18 of the support member 12. More specifically, the spring 112 biases the rib 116 into engagement with the channel 115. The channel 115 terminates within the upper portion of the support member 14 so as to prevent the arm rest member 16 from being pulled out from engagement with the support member 12. The T-shaped stop member 110 may be manufactured using spring steel and the spring 112 using piano wire.

To adjust the height of the arm rest member 12, for example from the height of FIG. 1 to that of FIG. 2, a user places an upward force on the actuation member 50. More particularly, a user places an upward force on the button 52 sufficient to overcome the oppositely directed force created by the spring 70. As shown in FIG. 2, by pushing upward on the button 52, the actuation element 50 pivots about the axis defined by the pin 54. The end 60 is directed downward with a resultant downward force applied to the link 80. As shown in FIG. 2, the cam 94 then pivots downward from engagement with the inner surface 18 of the support member 12. More specifically, because of the restricted movement of the cam 94 caused by the recess 100, the cam 94 pivots downward about a horizontal axis defined by the rear portion of the cam 98. The teeth 103 are then substantially disengaged from the inner wall 18. With the cam 94 in this downward angled position, a user could then move the arm rest member 16 upward or downward as desired.

After adjusting the arm rest member 16 to a new height (either higher or lower), the user then releases the button 52 of the actuation member 50. As a result, the spring 70 pulls upward on the end 60 of the actuation member 50. The cam 94 is then wedged back into engagement with the inner surface 18 of the support member 12, as shown in FIG. 1. In particular, the cam 94 returns to a substantially horizontal position so that the teeth 103 frictionally engage the inner wall 18 of the support member 12 in order to secure the arm rest member 16 at the new height. In a preferred embodiment, the rest member 16 has a range of movement of approximately 4 inches. In addition, it should be noted that as the user pushes downward on the arm rest member 16 with their elbow or forearm during use, the cam 94 is wedged further into engagement with the inner wall 18 and the recess 100 so as to further secure the arm rest member 16 at the selected height.

According to another aspect of the present invention, the arm rest member 16 cannot be pulled out from engagement with support member 12. In particular, the rib 116 on the stop member 110 rides within the channel 115 of the support member 12. However, because the channel 115 terminates in the upper portion of the support member 12, the rib 116 will run into the end of the channel 115 preventing the arm rest member 16 from being pulled out from engagement with the support member 12.

Figure 4:
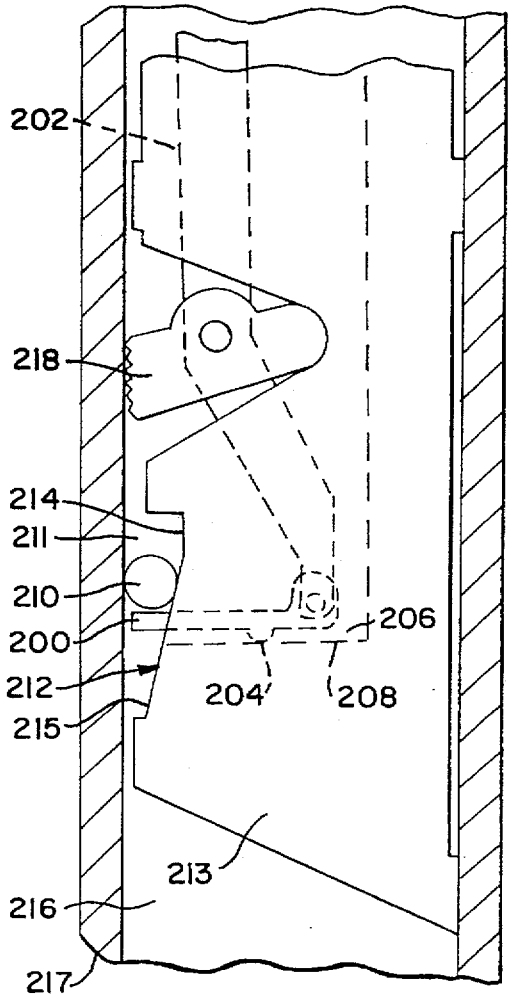
FIG. 4 is a side view in partial cross-section of the lower portion of an arm rest assembly of another preferred embodiment of the present invention with the arm rest member shown in the locked position.
Figure 5:
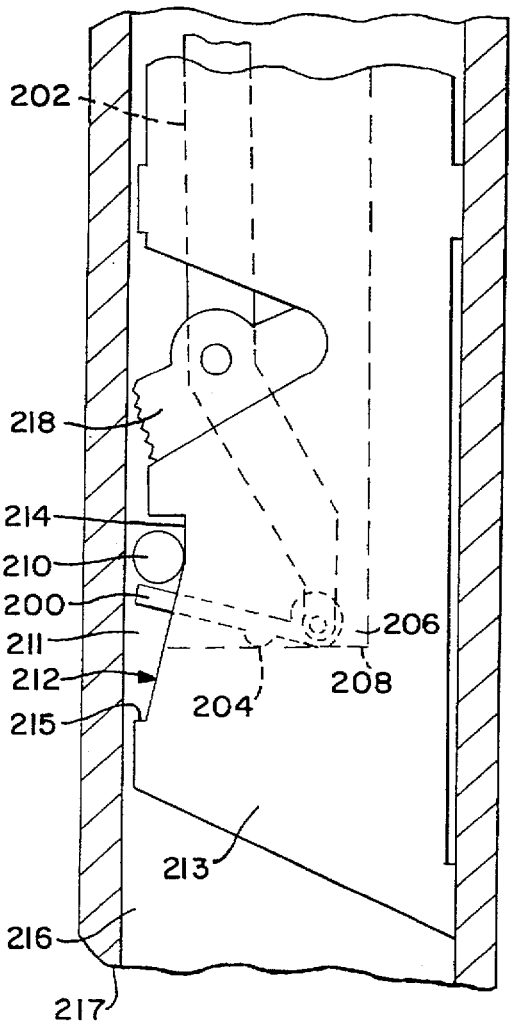
FIG. 5 is a side view in partial cross-section of the lower portion of an arm rest assembly of the preferred embodiment of the present invention shown in FIG. 4 with the arm rest member shown in the unlocked position.

A further preferred embodiment of the present invention is shown in FIGS. 4 and 5. Generally, this embodiment functions similarly to the embodiment shown in FIGS. 1–3. However, this embodiment prevents the arm rest member from being moved upward by a user without depressing the button on the actuation member. A lever arm 200 extends outward from the lower portion of the link 202 and is pivotably attached thereto. The lever arm 200 has a small ridge 204 that extends along the bottom surface thereof. The ridge 204 engages the recess 206 and, in particular, the lower wall 208. Accordingly, the lever arm 200 is spaced apart from the lower wall 208. The pin 210 rests in the cavity 211 defined by the lower wall 212 of the arm rest member 213. In one preferred embodiment, the pin 210 has a knurled outer surface. The lower wall 212 has a vertically extending upper portion 214 and a ramped surface 215 that extends toward the inner wall 216 of the support member 217. The cam 218 is pivotably connected to the link 202 and operates in the same general manner as that described above.

In operation, the embodiment of FIGS. 4–5 functions so as to prevent a user from moving the arm rest member upward without depressing the actuation member. More specifically, as shown in FIG. 4, when the actuation member is not depressed, the pin 210 is wedged between the inner wall 216 and the ramp 215. Accordingly, the pin 210 prevents the arm rest member 213 from being moved upward when in this position. In contrast, as shown in FIG. 5, when the actuation member is depressed, the link 202 pushes downward on the end of the lever arm 200. The lever arm 200 then pivots about the ridge 204 and places an upward force on the pin 210. The pin 210 is then pushed out from engagement with the ramp 215 toward the wider portion of the cavity 211 defined by the upper portion 214. As a result, the arm rest member 213 is now movable in the upward direction because the user has depressed the actuation member. When the user releases the actuation member, the lever arm 200 pivots back into the position as shown in FIG. 4. In this position, the arm rest member 213 is again locked into place.

Figure 6:
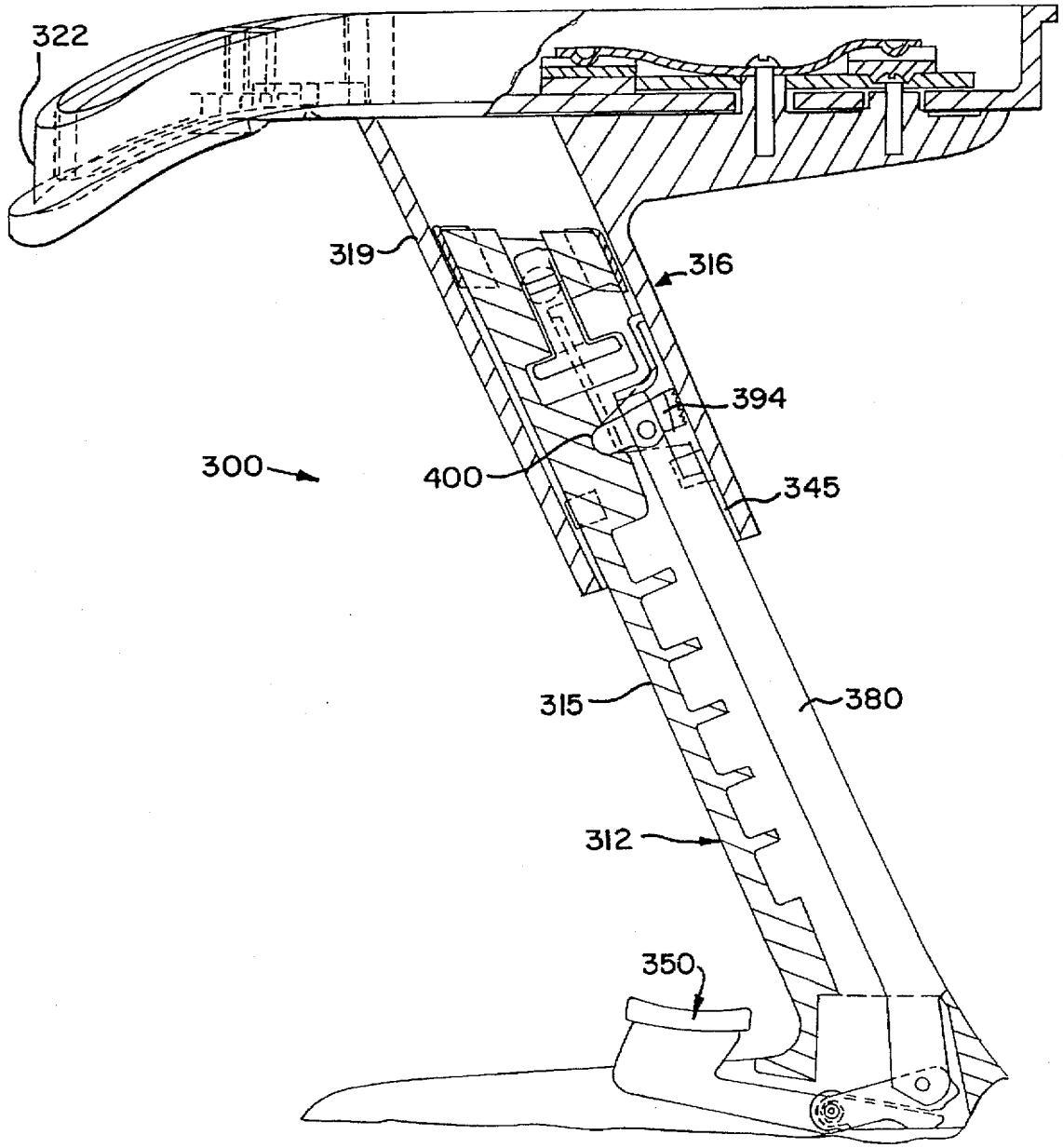
FIG. 6 is side view in partial cross-section of a further preferred embodiment of the present invention with the arm rest member shown having a sleeve and the support member shown having a stem.

It should be recognized that the specific male/female relationship of the elements of this invention could be modified by those of ordinary skill in the art so as to still practice the present invention. For example, the preferred embodiment of the arm rest assembly of the present invention could be modified as shown in FIG. 6. In general, the preferred embodiment of FIG. 6 operates in much the same way as the preferred embodiment of FIGS. 1–3. However, in contrast to the preferred embodiment shown FIGS. 1–3, the arm rest assembly 300 shown in FIG. 6 has a support member 312 that includes an actuation element 350, the link 380, the cam 394 and the recess 400. Also in contrast to the preferred embodiment of FIGS. 1–3, the support member 312 has a stem 315 (a male element) that extends upward and mates with a sleeve 319 (a female element) in the arm rest member 316. In one preferred embodiment, the inner wall 345 of the sleeve 319 is substantially smooth and forms an engagement surface that interacts with the cam 394. The arm rest housing 322 receives an arm pad that would support the arm of a user.

As shown in FIG. 6, the arm rest member 316 is locked into a fixed position. In order to adjust the height of the arm rest member 316, a user would depress the actuation element 350 so as to disengage the cam 394 from the inner wall 345 of the sleeve 319. At this point, the arm rest member 316 could then be moved to a new height by the user. Once the user released the actuation element 350, the cam 394 would then pivot back into engagement with the inner wall 345 of the sleeve 319. The arm rest member 316 would then be fixed into position at a new height.

The embodiments described are illustrative and not restrictive. The scope of the invention is indicated by the claims rather than by the foregoing description. The invention may be embodied in other specific forms without departing from the spirit of the invention. For example, as described above, the connection of the cam and the continuous engagement surface relative to the support member and the arm rest member could be interchanged. Similarly, the materials used or the exact configuration of any part may also be changed as recognized by those of ordinary skill in the art. Accordingly, all changes which come within the scope of the claims are intended to be embraced therein.

I claim:

1. A height adjustable arm rest assembly for use on a chair, said arm rest assembly comprising:

a support member;

an arm rest member attached to said support member, said support member and said arm rest member extending substantially coaxially, one of said support member and said arm rest member being movable with respect to the other;

a locking mechanism attached to one of said support member and said arm rest member in order to secure said arm rest member in a selected vertical position relative to said support member, said locking mechanism comprising:

an actuation member;

a link connected to said actuation member; and a cam pivotably connected to said link, said cam having a front portion and a rear portion, said rear portion received within a recess of said one of said support member and said arm rest member, said recess sized slightly larger than said rear portion of said cam in order to allow said cam to pivot about a generally horizontal axis through said rear portion of said cam from a first position to a second position within said recess; and a substantially continuous engagement surface on the other of said support member and said arm rest member, said cam positioned adjacent said continuous engagement surface and pivotable into and out of engagement with said continuous engagement surface in response to said actuation member in order to thereby provide said arm rest member with selective height adjustability.

2. The height adjustable arm rest assembly according to claim 1 further comprising a biasing member connected to said locking mechanism in order to bias said cam into engagement with said continuous engagement surface.

3. The height adjustable arm rest assembly according to claim 2 wherein said biasing member comprises a U-shaped spring.

4. The height adjustable arm rest assembly according to claim 3 wherein said link further includes a resilient foot member that projects downward from beneath said cam and contacts said continuous engagement surface.

5. The height adjustable arm rest assembly according to claim 4 wherein the support member defines an aperture through which said arm rest member partially extends.

6. The height adjustable arm rest assembly according to claim 5 wherein said locking mechanism further includes a laterally extending pin passing through said actuation member and defining a pivot axis.

7. The height adjustable arm rest assembly according to claim 6 wherein said arm rest member has a T-shaped aperture therein that receives a T-shaped stop member having an outwardly projecting raised surface that is received within a channel extending within said support member.

8. The height adjustable arm rest assembly according to claim 7 wherein said cam includes a curved rear portion and plurality of longitudinally extending teeth on said front portion.

9. The height adjustable arm rest assembly according to claim 8 wherein said recess is defined by a curved rear surface.

10. A height adjustable arm rest assembly for use on a chair, said arm rest assembly comprising:

a support member having a substantially continuous inner surface that defines a cavity;

an arm rest member having a stem extending generally downward therefrom and slidably received within said cavity of said support member;

a locking mechanism attached to said arm rest member in order to secure said arm rest member in a selected vertical position relative to said support member, said locking mechanism comprising:

an actuation member;

a link connected to said actuation member and extending downward therefrom; and a cam pivotably connected to a lower portion of said link and positioned adjacent the continuous inner surface of the support member and positioned partially within a recess in said arm rest member, said recess sized slightly larger than a rear portion of said cam in order to allow said cam to pivot about a generally horizontal axis through said rear portion of said cam from a first position to a second position within said recess, said cam having a front surface that is movable into and out of engagement with said continuous inner surface of said support member in response to said actuation member in order to thereby provide the arm rest member with selective height adjustability.

11. The height adjustable arm rest assembly according to claim 10 wherein said support member has a channel extending substantially vertically therein that terminates prior to a top of said support member.

12. The height adjustable arm rest assembly according to claim 11 wherein said arm rest member has a T-shaped aperture therein that receives a T-shaped stop member having an outwardly projecting raised surface that is received within said channel.

13. The height adjustable arm rest assembly according to claim 12 further including a spring received within an aperture in said stem, said spring biasing said raised surface of said stop member into said channel.

14. The height adjustable arm rest assembly according to claim 13 wherein said cam includes a plurality of longitudinally extending teeth.

15. A height adjustable arm rest assembly for use on a chair, said arm rest assembly comprising: p1 a support member having a substantially D-shaped and continuous inner surface that defines a cavity;

an arm rest member having a stem extending generally downward therefrom and slidably received within said cavity of said support member, said arm rest member including a first recess and a second recess;

a locking mechanism attached to said arm rest member in order to secure said arm rest member in a selected vertical position relative to said support member, said locking mechanism comprising:

an actuation member;

a link connected to said actuation member and extending downward therefrom, said link having an upper portion and a lower portion, said lower portion including a pivotable laterally extending lever arm;

a cam pivotably connected to said link and positioned directly adjacent said continuous inner surface of said support member, said cam having a front portion and a rear portion, said rear portion received within said first recess, said first recess sized slightly larger than a rear portion of said cam in order to allow said cam to pivot from a first position to a second position within said recess; and a locking element resting on an end portion of said lever arm of said link, said locking element received within said second recess.

16. The height adjustable arm rest assembly according to claim 15 wherein said second recess is defined by an angled surface that extends upward.

17. The height adjustable arm rest assembly according to claim 16 wherein said locking element is a pin.

18. The height adjustable arm rest assembly according to claim 17 further comprising a biasing member connected to said locking element in order to bias said cam into engagement with said continuous engagement surface.

19. The height adjustable arm rest assembly according to claim 18 wherein said cam has a curved rear portion and a plurality of longitudinally extending teeth on said front portion.

20. The height adjustable arm rest assembly according to claim 19 wherein said first recess is defined by a curved rear surface.

21. A height adjustable arm rest assembly for use on a chair, said assembly comprising:

a support member having a sleeve that extends upwardly from said chair, the support member further including a substantially continuous engagement surface on an inner surface of the sleeve;

an arm rest member including a downwardly extending stem which is slidably received within the sleeve;

a locking mechanism attached to one of said support member and said arm rest member, said locking mechanism comprising:

an actuation member a link connected to the actuation member;

a generally wedge-shaped recess in the stem which opens toward the engagement surface;

a cam received within the recess, said cam including a front, middle and rear portion, said middle portion being connected to said link, said cam being of a size and shape so as to allow the cam to pivot in response to movement of the actuation member, the cam pivotable within the recess about a generally horizontal axis through the rear portion of the cam between a locking position wherein the front portion of the cam engages the engagement surface in the sleeve and a release position wherein the cam disengages the engagement surface, and wherein the cam has a length great enough to prevent the cam from pivoting past the locking position.

22. The height adjustable arm rest assembly of claim 21 wherein said cam pivots downward in order to disengage from the engagement surface.

23. The height adjustable arm rest assembly of claim 22 wherein said recess has a width substantially equal to a width of said cam.

24. The height adjustable arm rest assembly of claim 23 wherein said rear portion of said cam defines a pivot axis about which said cam pivots.

25. The height adjustable arm rest assembly of claim 24 wherein said recess is substantially V-shaped.

26. A height adjustable arm rest assembly for use on a chair, said assembly comprising:

an arm rest member having a sleeve with a substantially continuous engagement surface on an inner surface of the sleeve;

a support member for attachment to said chair and extending substantially upward therefrom, said support member including a stem adapted to extend upwardly from said chair;

a locking mechanism attached to said support member, said locking mechanism comprising:

an actuation member a link connected to the actuation member;

a generally wedge-shaped recess in the stem which opens toward the engagement surface;

a cam received within the recess, said cam including a front, middle and rear portion, said middle portion being connected to said link, said cam being of a size and shape so as to allow the cam to pivot in response to movement of the actuation member, the cam pivotable within the recess about a generally horizontal axis through the rear portion of the cam between a locking position wherein the front portion of the cam engages the engagement surface in the sleeve and a release position wherein the cam disengages the engagement surface, and wherein the cam has a length great enough to prevent the cam from pivoting upward past the locking position.

27. The height adjustable arm rest assembly of claim 26 wherein said cam pivots downward in order to disengage from the engagement surface.

28. The height adjustable arm rest assembly of claim 27 wherein said recess has a width substantially equal to a width of said cam.

29. The height adjustable arm rest assembly of claim 28 wherein said rear portion of said cam defines said pivot axis about which said cam pivots.

30. The height adjustable arm rest assembly of claim 28 wherein said recess is substantially V-shaped.

* * * * *

UNITED STATES PATENT AND TRADEMARK OFFICE

CERTIFICATE OF CORRECTION

PATENT NO. : 5,667,277

DATED : September 16, 1997

INVENTOR(S) : Douglas M. Van De Riet

It is certified that error appears in the above-indentified patent and that said Letters Patent is hereby corrected as shown below:

In the Claims

Claim 15, line 2, delete "p1".

Claim 21, line 12, after "member" add --;-- (semicolon).

Claim 26, line 12, after "member" add --;-- (semicolon).

Signed and Sealed this

Twenty-first Day of March, 2000

*Attest:*

*Attesting Officer*

Q. TODD DICKINSON

*Commissioner of Patents and Trademarks*